US006099346A

United States Patent [19]

Hashiguchi et al.

[11] Patent Number: 6,099,346

[45] Date of Patent: Aug. 8, 2000

[54] CABLE CONNECTOR CAPABLE OF SURELY CONNECTING A CABLE

[75] Inventors: Osamu Hashiguchi, Akishima; Yu Tatebe, Hachioji; Kanji Inoue, Tokyo, all of Japan

[73] Assignee: Japan Aviation Electronics Industry, Limited, Tokyo, Japan

[21] Appl. No.: 09/294,299

[22] Filed: Apr. 19, 1999

[30] Foreign Application Priority Data

Jul. 31, 1998 [JP] Japan ..... 10-217584
Jan. 11, 1999 [JP] Japan ..... 11-004558

[51] Int. Cl.[7] ..... H01R 12/24

[52] U.S. Cl. ..... 439/495; 439/260

[58] Field of Search ..... 439/495, 494, 439/496, 260, 261

[56] References Cited

U.S. PATENT DOCUMENTS

| | | | |
|---|---|---|---|
| 4,367,006 | 1/1983 | Rehbogen, Jr. et al. | 439/495 |
| 5,240,430 | 8/1993 | Soes | 439/260 |
| 5,259,777 | 11/1993 | Schuder et al. | 439/188 |
| 5,401,186 | 3/1995 | Nozaki et al. | 439/495 |
| 5,478,261 | 12/1995 | Bogese, II | 439/676 |
| 5,695,360 | 12/1997 | Seto et al. | 439/495 |
| 5,785,549 | 7/1998 | Takayasu | 439/495 |
| 5,839,917 | 11/1998 | Takahashi et al. | 439/495 |
| 5,842,883 | 12/1998 | Igarashi et al. | 439/495 |

FOREIGN PATENT DOCUMENTS

| | | |
|---|---|---|
| 9-35828 | of 1997 | Japan . |
| 9-92411 | of 1997 | Japan . |

*Primary Examiner*—Neil Abrams
*Assistant Examiner*—Hae Moon Hyeon
*Attorney, Agent, or Firm*—Laff, Whitesel & Saret, Ltd.; J. Warren Whitesel

[57] ABSTRACT

In a cable connector for use in connecting a cable having a first and a second surface opposite to each other in twin thickness direction thereof, a conductive contact has twin contact portions to be opposed to the first surface and a pivot portion to be opposed to the second surface. A handle is used for pressing the cable between the twin contact portions. The handle has a cam portion positioned between the pivot portion and the cable and is made with a hole in which the pivot portion is inserted with a clearance. The pivot portion has a concavity corresponding to the cam portion. The cam portion engages with the pivot portion so that the handle is rotatable around the pivot portion.

6 Claims, 7 Drawing Sheets

CABLE CONNECTOR CAPABLE OF SURELY CONNECTING A CABLE

BACKGROUND OF THE INVENTION

The present invention relates to a cable connector, particularly to a cable connector suitable for connecting a cable such as a flat ribbon cable and an FPC (Flexible Printed Circuit).

Cable connectors of the type are disclosed in, for example, Japanese Patent Laid-Open Publication Nos. 9-35828 and 9-92411. An example of such cable connectors will be described with reference to FIGS. 13 and 14. A cable connector shown in the drawings comprises an insulator 2 for receiving an FPC 1, conductive contacts 3 fixed to the insulator 2 at predetermined pitches, and a handle 4 for pressing the FPC 1 on the contacts 3.

Each contact 3 has a contact portion 5 and a pivot portion 6, both of which are formed integrally with the contact 3. The contact portion 5 is to be opposed to one surface of the FPC 1, and the pivot portion 6 is to be opposed to the other surface of the FPC 1. The circumference of the pivot portion 6 is formed into an arc of a circle so that an arched concavity 7 formed in the handle 4 is fitted to the pivot portion 6. The handle 4 is thereby swingable around the pivot portions 6 of the contacts 3 between first and second positions shown in FIGS. 13 and 14, respectively.

When the handle 4 is at the first position, the FPC 1 can be easily inserted into a cable insertion portion 8 of the insulator 2. When the handle 4 is rotated from the first position to the second position in the state that the FPC 1 is inserted in the cable insertion portion 8, a wedge portion 9 of the handle 4 presses the FPC 1. The FPC 1 is thereby pressed to the contact portions 5 of the contacts 3, which portions are elastically deformed, and so electrically connected to them.

In case of an FPC 1 with many conductors, however, the above-described cable connector is disadvantageous because the operation force for the handle 4 increases due to the friction between the wedge portion 9 of the handle 4 and the FPC 1 and the friction between the FPC 1 and the contact portions 5.

Besides, because the handle 4 is provided with shafts only at both its ends, there is a case that the FPC 1 with many conductors causes a state as shown in FIG. 15, in which the wedge portion 9 of the handle 4 does not effectively operate due to the above-described frictions.

Besides, if the FPC 1 is pulled upward, that is, in the direction of the pivot portions 6 as shown in FIG. 16, the force of raising the FPC 1 is transmitted as it is to raise the handle 4. In that case, the handle 4 may return to the first position. This is a problem in the reliability of connection.

SUMMARY OF THE INVENTION

It is an object of the present invention to provide a cable connector, which can be operated by a little force even in case of a cable with many conductors.

It is another object of the present invention to provide a cable connector, which has an operation surely carried out even in case of a cable with many conductors.

It is still another object of the present invention to provide a cable connector in which the reliability of connection is improved.

Other objects of the present invention will become clear as the description proceeds.

According to an aspect of the present invention, there is provided a cable connector for use in connecting a cable having a first and a second surface opposite to each other in a thickness direction thereof. The cable connector comprises a conductive contact including a contact portion to be opposed to the first surface and a pivot portion to be opposed to the second surface, an insulator holding the conductive contact, and a handle coupled to the insulator for pressing the cable onto the contact portion. In the cable connector, the handle comprises a cam portion positioned between the pivot portion and the cable and a hole defining surface defining a hole in which the pivot portion is inserted with a clearance. The pivot portion has a concavity corresponding to the cam portion. The cam portion engages with the pivot portion so that the handle is rotatable around the pivot portion.

According to another aspect of the present invention, there is provided a cable connector for use in connecting a cable having a first and a second surface opposite to each other in a thickness direction thereof. The cable connector comprises a conductive contact comprising a contact portion to be opposed to the first surface and a pivot portion to be opposed to the second surface, an insulator holding the conductive contact, and a handle coupled to the insulator for pressing the cable onto the contact portion. In the cable connector, the contact portion has a plurality of contact-side projections which are adjacent to each other with a distance left therebetween. The handle has a handle-side projection which is opposed to the distance through the cable in the thickness direction. The handle-side and the contact-side projections being cooperated with each other to engage with the cable.

DESCRIPTION OF THE PREFERRED EMBODIMENTS

Figure 1:
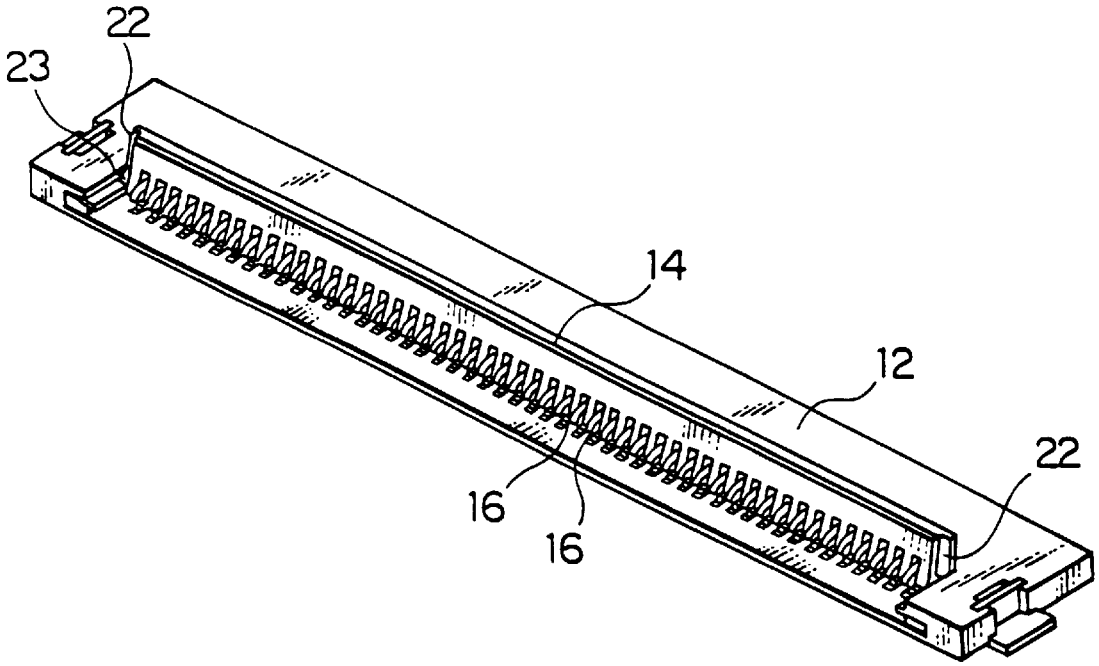
FIG. 1 is a perspective view of a cable connector according to a first embodiment of the present invention.
Figure 2:
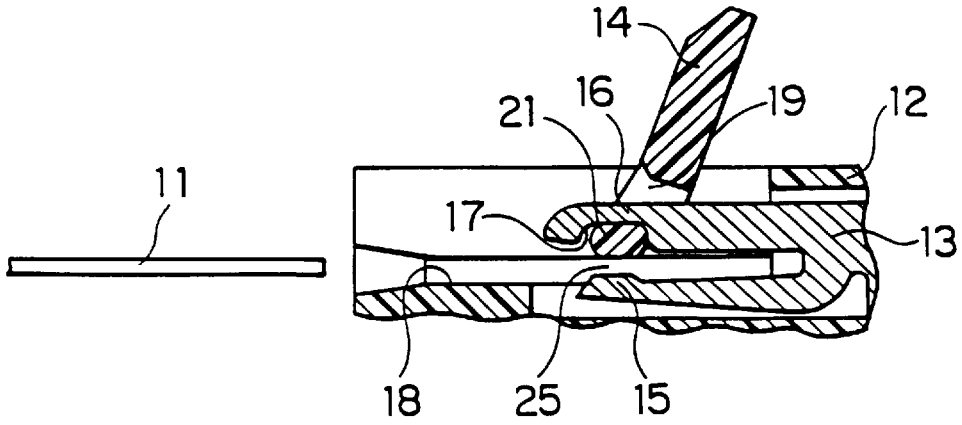
FIG. 2 is a cross-sectional view of an essential part of the cable connector of FIG. 1 at its middle portion.
Figure 3:
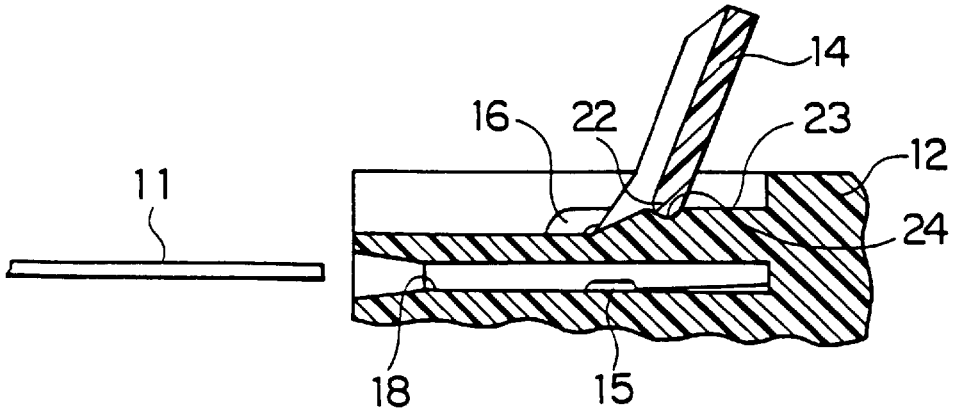
FIG. 3 is a cross-sectional view of an essential part of the cable connector of FIG. 1 at its end portion.

Referring to FIGS. 1–3, description will be made as regards a cable connector according to the first embodiment of the present invention.

The cable connector comprises an insulator 12 for receiving an FPC 11, which is a kind of flat cable, a large number of conductive contacts 13 aligned in the right and left directions at predetermined pitches and fixed to the insulator 12, and an handle 14 for pressing the FPC 11 on the contacts 13. The FPC 11 has a first and a second surface which are opposite to each other in a thickness direction of the FPC 11.

Each contact 13 has a contact portion 15 and a pivot portion 16, both of which are formed integrally with the contact 13. The contact portion 15 is to be opposed to the first surface of the FPC 11, and the pivot portion 16 is to be opposed to the second surface of the FPC 11. That is, the contact portion 15 and the pivot portion 16 are vertically opposed to each other at a space. The pivot portion 16 is provided with a concavity 17 formed at the position opposite to the contact portion 15.

The insulator 12 is provided with a cable insertion portion 18 according to the space between the contact portions 15 and the pivot portions 16 of the contacts 13. The FPC 11 is inserted into the cable insertion portion 18. Because the space between the contact portions 15 and the pivot portions 16 is sufficiently larger than the thickness of the FPC 11, the FPC 11 can be inserted with ease.

The handle 14 is a boardlike member long in the right and left directions. The handle 14 is provided with a large number of holes 19, each of which corresponds to the pivot portion 16 of each contact 3. In other words, the handle 14 has hole defining surfaces defining the holes 19, respectively. The handle 14 is joined with the insulator 12 in the state that each pivot portion 16 is inserted in the corresponding hole 19. The dimensions of each hole 19 are determined such that the corresponding pivot portion 16 is inserted with a clearance.

The handle 14 is provided with cam portions 21, each of which is positioned in the concavity 17 of each pivot portion 16 when the handle 14 is joined with the insulator 12. In this embodiment, each cam portion 21 has a cross section of an oval shape that two semicircles are connected with two straight lines, though various modifications in it are possible. In this manner, the cam portions 21 of the handle 14 are engaged with the pivot portions 16 so that the handle 14 is rotatable around the pivot portions 16.

The handle 14 is further provided with protruding portions 22 at both its ends in the right and left directions. On the other hand, the insulator 12 is provided with protrusion-receiving portions 23, each of which expands upward, at the positions corresponding to the respective protruding portions 22. Each protrusion-receiving portion 23 is provided with a protrusion engagement groove 24, which works as an engagement portion for engaging with the corresponding protruding portion 22 of the handle 14.

When the handle 14 is open at the first position as shown in FIGS. 1 to 3, the protruding portions 22 of the handle 14 engage with the protrusion engagement grooves 24 of the protrusion-receiving portions 23 of the insulator 12, respectively, to hold the handle 14 at the first position. At this time, each cam portion 21 of the handle 14 is held in the state that its longitudinal axis is horizontal within the concavity 17 of the pivot portion 16 of the corresponding contact 13. As a result, a space 25 larger than the thickness of the FPC 11 is formed between each cam portion 21 and the contact portion 15 of each contact 13. The FPC 11, therefore, can be easily inserted into the cable insertion portion 18 of the insulator 12 when the handle 14 is at the first position.

Figure 4:
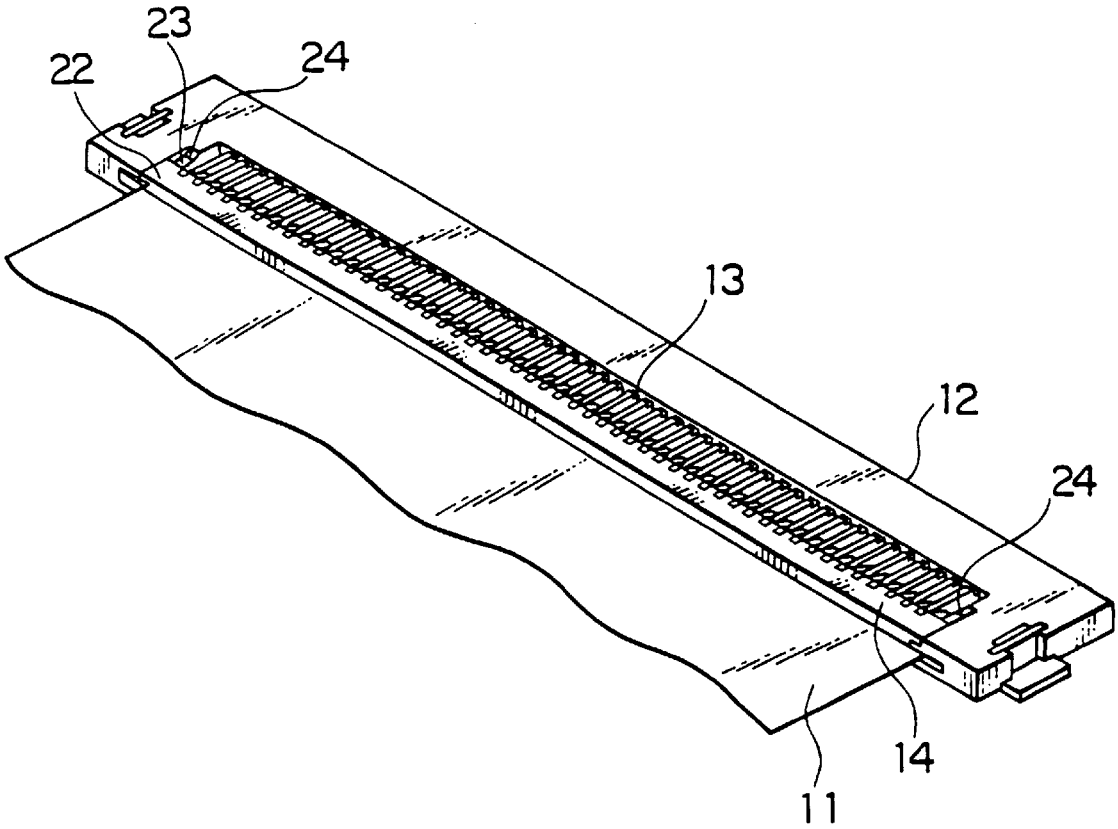
FIG. 4 is a perspective view of the cable connector of FIG. 1 in a state that a cable is connected.
Figure 5:
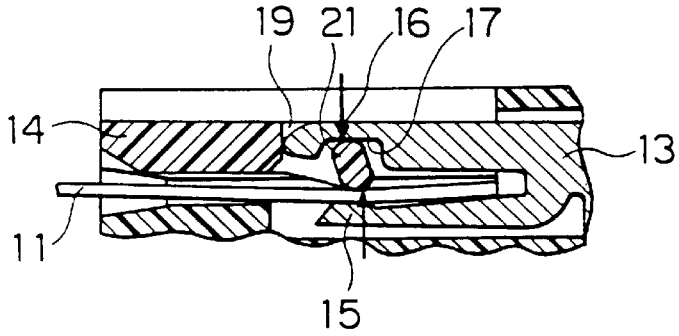
FIG. 5 is a cross-sectional view of the essential part of the cable connector of FIG. 1 at its middle portion in the state that the cable is connected.

When the handle 14 is rotated from the first position to the second position shown in FIGS. 4 and 5 in the state that the FPC 11 is inserted in the cable insertion portion 18, the FPC 11 is pressed by each rotating cam portion 21 of the handle 14. As a result, the FPC 11 is pressed to the contact portions 15 of the contacts 13, which portions are elastically deformed, and so electrically connected to them.

Each cam portion 21 is designed to receive forces in directions shown by arrows in FIG. 5 from the corresponding pivot portion 16 and the corresponding contact portion 15 through the FPC 11 when the handle 14 is in the fitted-in state (that is, at the second position). The handle 14 thus receives a closing force in the fitted-in direction when it is at the second position. The handle 14, therefore, never moves with ease to the getting-off direction (that is, toward the first position) when it is in the fitted-in state.

In the cable connector, because a sufficient contact pressure can be obtained from a little operation force by utilizing a magnified force of the latter by leverage, a moderate operability can be obtained even if the number of conductors increases to some extent. Besides, because each cam portion 21 of the handle 14 is inhibited from moving in three directions of the upside, right and left by the pivot portion 16 of the corresponding contact 13, the cam portion 21 never gets out of the pivot portion 16 due to the friction between it and the FPC 11 even in case of the number of conductors increasing, and all conductors can be surely connected. Moreover, because the protruding portions 22 at both ends of the handle 14 are supported by both end portions of the insulator 12 when the handle 14 is at the first position, the space 25 between each cam portion 21 and the contact portion 15 of each contact 13 can be always kept larger than the thickness of the FPC 11.

Turning to FIGS. 6 to 9, the description will be made as regards a cable connector according to the second embodiment of the present invention. Similar parts are designated by like reference numerals.

In the cable connector, the insulator 12 is provided with cable engagement grooves 26 at both ends of the cable insertion portion 18 in the right and left directions. Each cable engagement groove 26 has a vertical width slightly larger than the thickness of the FPC 11 to receive with play the corresponding side edge in a width direction of the FPC 11 inserted in the cable insertion portion 18. Movement of the FPC 11 is thus limited in directions along its thickness.

Figure 6:
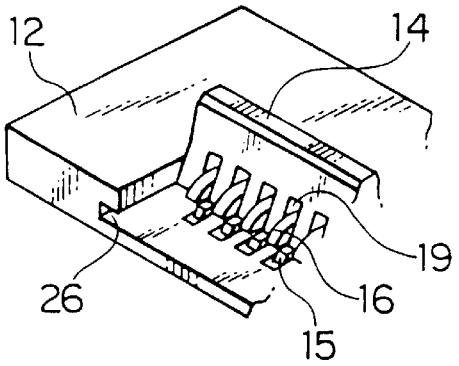
FIG. 6 is a perspective view of an essential part of a cable connector according to a second embodiment of the present invention.
Figure 7:
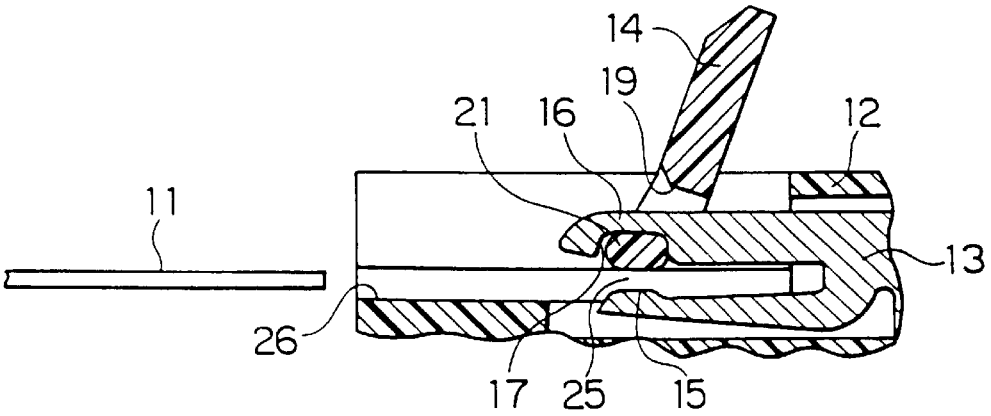
FIG. 7 is a cross-sectional view of an essential part of the cable connector of FIG. 6 like FIG. 2.

When the handle 14 is at the first position shown in FIGS. 6 and 7, the FPC 11 can be easily inserted into the cable insertion portion 18 of the insulator 12. At this time, each side edge of the FPC 11 is inserted into each cable engagement groove 26 of the insulator 12.

Figure 8:
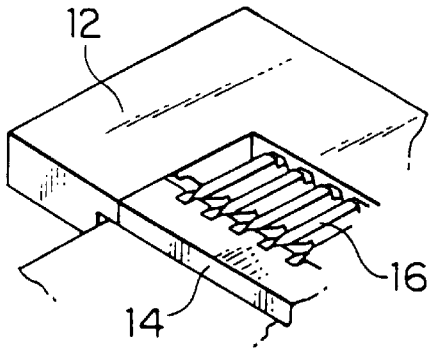
FIG. 8 is a perspective view of the essential part of the cable connector of FIG. 6 in a state that a cable is connected.
Figure 9:
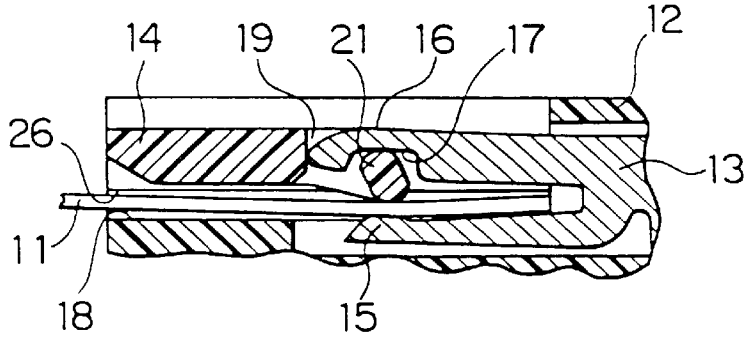
FIG. 9 is a cross-sectional view of the essential part of the cable connector of FIG. 6 like FIG. 5.

When the handle 14 is rotated from the first position to the second position shown in FIGS. 8 and 9 in the state of the FPC 11 being inserted, the FPC 11 is pressed by each rotating cam portion 21 of the handle 14. As a result, the FPC 11 is pressed to the contact portions 15 of the contacts 13, which portions are elastically deformed, and so electrically connected to them.

Even if the FPC 11 is pulled upward, that is, in the direction of the pivot portions 16 in this connection state, both side edges of the FPC 11 are stopped by the cable engagement grooves 26 of the insulator 12, and so the handle 14 is hardly pressed by external force. There is no possibility that the handle 14 returns to the first position. The reliability of connection is therefore improved.

Besides, there is a merit that the operability of insertion is improved because the cable engagement grooves 26 serve as insertion guides when the FPC 11 is inserted.

As described above, a cable connector according to the present invention can be operated by a little force even in case of a cable with many conductors. Besides, it surely operates even in case of a cable with many conductors. Furthermore, the reliability of connection is improved.

Figure 10:
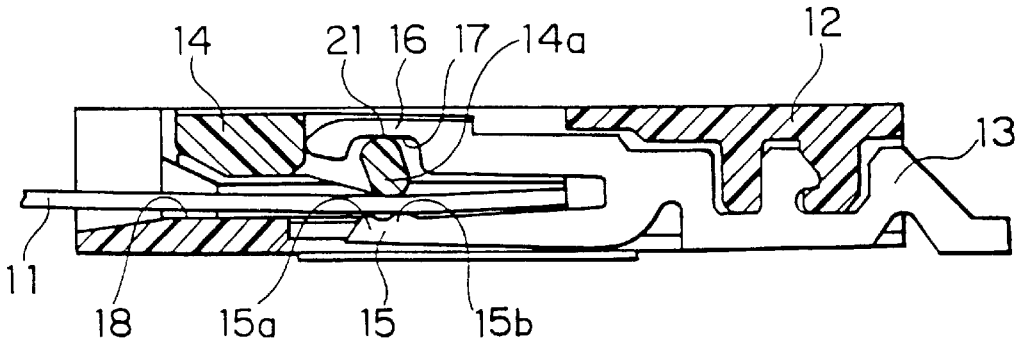
FIG. 10 is a cross-sectional view of a cable connector according to a third embodiment of the present invention.

Turning to FIG. 10, the description will be made as regards a cable connector according to a third embodiment of the present invention. Similar parts are designated by like reference numerals.

Also to the cable connector, the FPC 11 is connected in the manner which will be described below. First, the FPC 11 is set so that the first surface is opposite to the contact portions 15 of the contacts 13. Thereafter, the second surface of the FPC 11 is pressed towards the contact portions 15 by the rotary handle 14. As a result, the FPC 11 is brought in press contact with the contacts 13.

In the cable connector, each of the contact portions 15 has at least two contact-side projections 15*a* and 15*b* which are adjacent to each other with a distance left therebetween. On the other hand, the cam portion 21 of the handle 14 has a handle-side projection 14*a* which is opposed to the distance through the FPC 11 in the thickness direction when the FPC 11 is connected to the cable connector. In the manner which will later become clear, the handle-side and the contact-side projections 14*a*, 15*a*, and 15*b* are cooperated with each other to engage with the FPC 11.

When pressed down by the cam portion 21 with rotation of the handle 14, the FPC 11 is brought into press contact with the contact portions 15 with elastic deformation of the contact portions 15 of the contacts 13. Therefore, the FPC 11 is electrically connected to the cable connector.

In this state, the handle-side projection 14*a* is opposed to the distance between the contact-side projections 15*a* and 15*b* to engage with the contact-side projections 15*a* and 15*b* through the FPC 11. Consequently, probability of causing contact failure is decreased because contact points are increased between the FPC 11 and the contacts 13. In addition, the handle-side and the contact-side projections 14*a*, 15*a*, and 15*b* are engaged with each other to hold the FPC 11. Therefore, the cable connector is improved in reliability of contact between the FPC 11 and the contacts 13.

Figure 11:
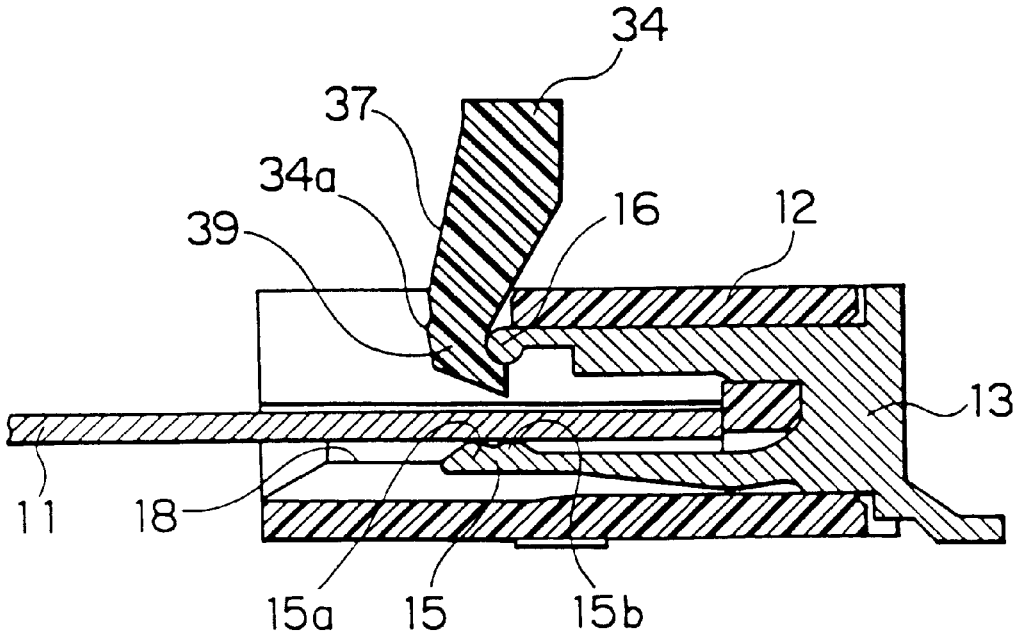
FIG. 11 is a cross-sectional view of a cable connector according to a fourth embodiment of the present invention, where a cable is not connected to the cable connector although it is set therein.
Figure 12:
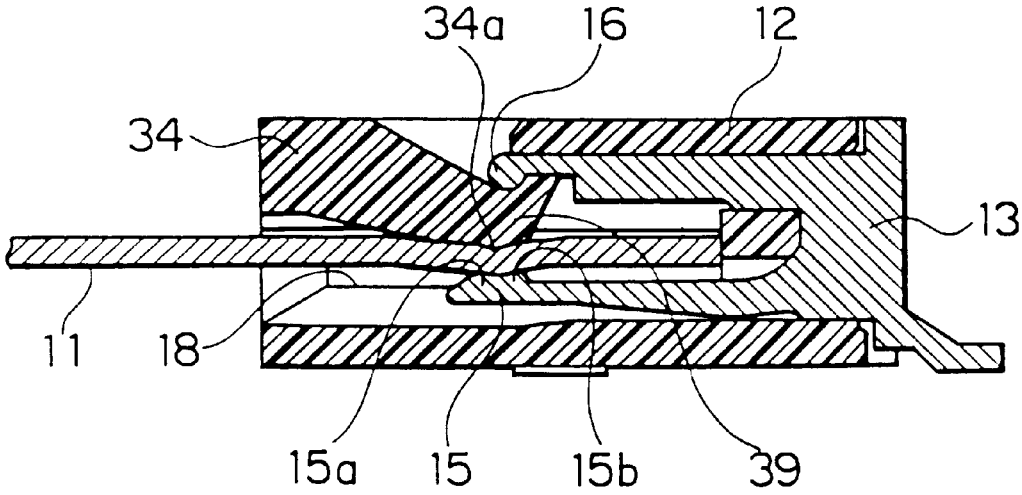
FIG. 12 is a cross-sectional view of the cable connector of FIG. 11, where the cable is connected to the cable connector.
Figure 13:
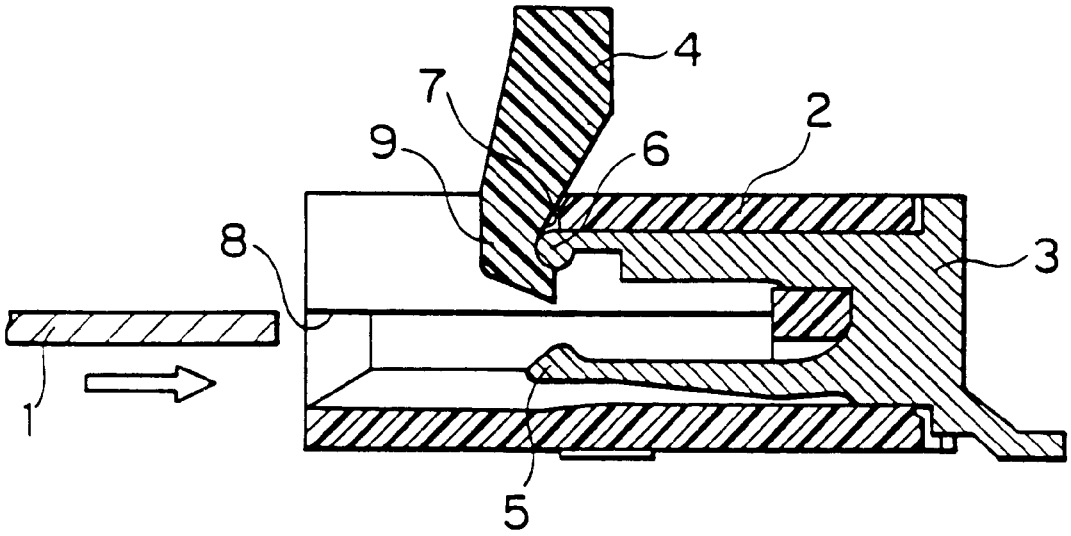
FIG. 13 PRIOR ART
FIG. 13 is a cross-sectional view of a prior art cable connector.
Figure 14:
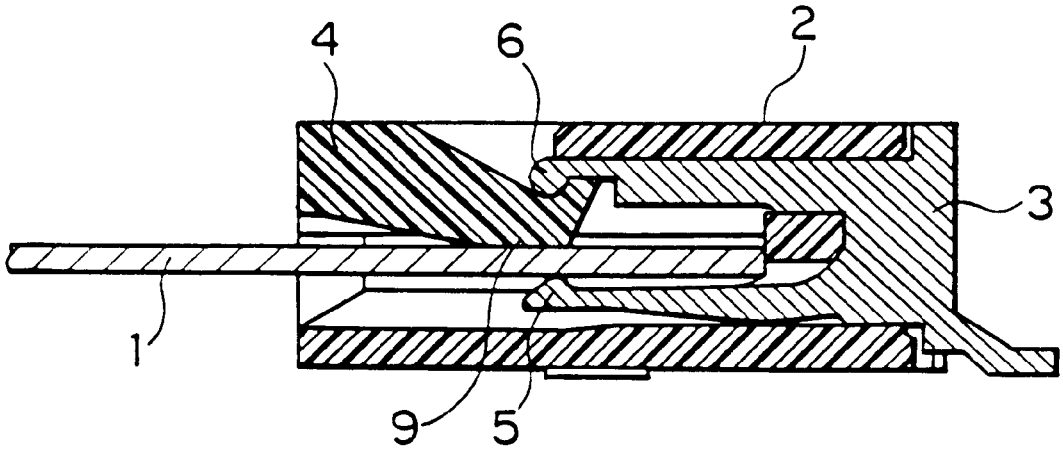
FIG. 14 PRIOR ART
FIG. 14 is a cross-sectional view of the cable connector of FIG. 13 when a cable is connected.
Figure 15:
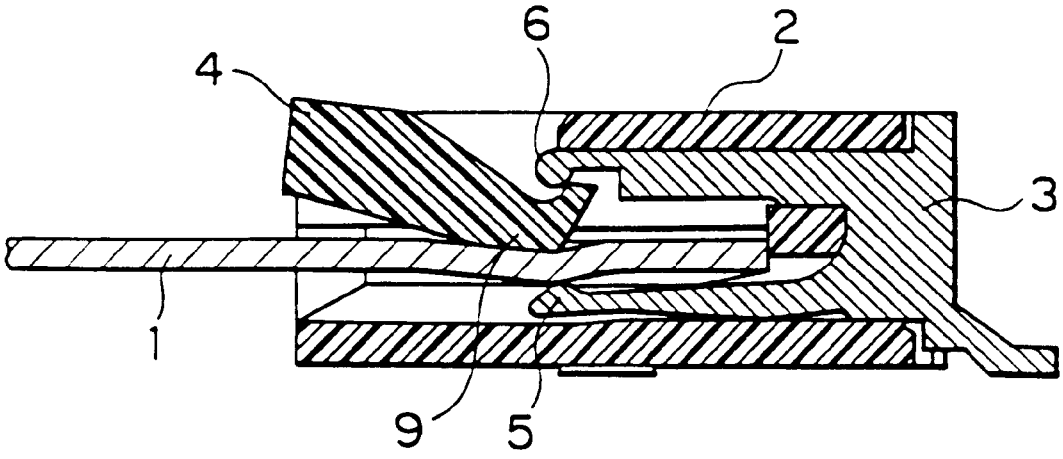
FIG. 15 PRIOR ART
FIG. 15 is a cross-sectional view of the cable connector of FIG. 13 for illustrating a problem therein.
Figure 16:
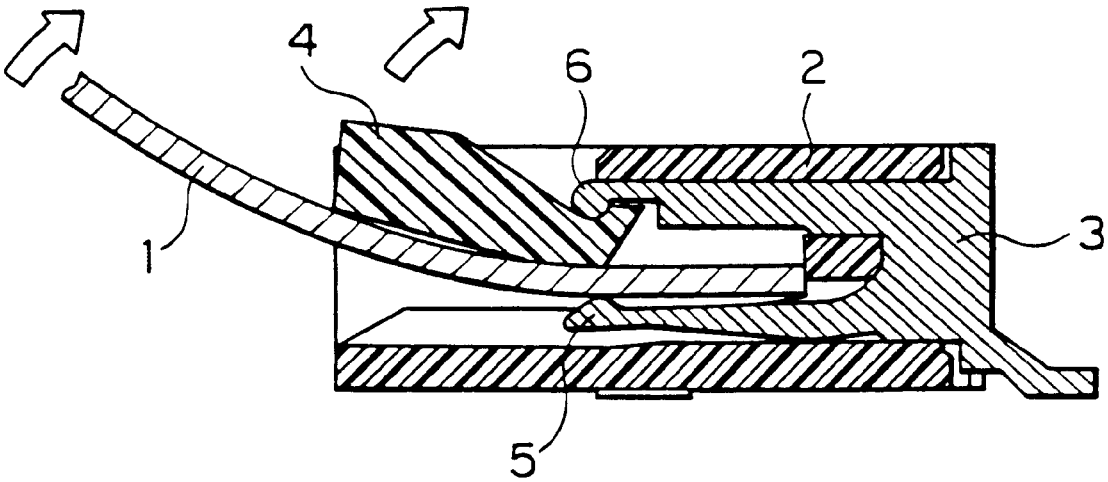
FIG. 16 PRIOR ART
FIG. 16 is a cross-sectional view of the cable connector of FIG. 13 for illustrating another problem therein.

Turning to FIGS. 11 and 12, the description will be made as regards a cable connector according to a fourth embodiment of the present invention. Similar parts are designated by like reference numerals.

Also to the cable connector, the FPC 11 is connected in the manner which will be described below. First, the FPC 11 is set so that the first surface is opposite to the contact portions 15 of the contacts 13. Thereafter, the second surface of the FPC 11 is pressed towards the contact portions 15 by the rotary handle 34. As a result, the FPC 11 is brought in press contact with the contacts 13.

In each contact 13, the contact portion 15 and the pivot portion 16 are integral with each other. The pivot portion 16 has an outer peripheral surface formed in a circular shape and is fitted into a circular recess 37 which is made to a handle 34. With this arrangement, the handle 34 is rotatable around the pivot portion 16 between a first and a second position which are illustrated in FIGS. 11 and 12, respectively.

In the cable connector, at least two contact-side projections 15*a* and 15*b* are formed to the contact portion 15 of each contact 13. On the other hand, the handle 34 is formed with a wedge portion 39 operable as a cam portion. The wedge portion 39 is formed with a handle-side projection 34*a* which is opposed to the distance between the contact-side projections 15*a* and 15*b* when the FPC 11 is connected to the cable connector.

When the handle 34 is at the first position, the FPC 11 can readily be inserted into the cable insertion portion 18. When the handle 34 is rotated from the first position to the second position with the FPC 11 being inserted in the cable insertion portion 18, the FPC 11 is pressed down by the wedge portion 39 of the handle 34. Consequently, the FPC 11 becomes in press contact with the contact portion 15 with the elastic deformation of the contact portion 15. Thus, the EPC 11 is electrically connected to the cable connector.

In this state, the handle-side projection 34*a* is opposed to the distance between the contact-side projections 15*a* and 15*b* to engage with the contact-side projections 15*a* and 15*b* through the FPC 11. Consequently, probability of causing contact failure is decreased because contact points are increased between the FPC 11 and the contacts 13. In addition, the handle-side and the contact-side projections 14*a*, 15*a*, and 15*b* are engaged with each other to hold the FPC 11. Therefore, the cable connector is improved in reliability of contact between the FPC 11 and the contacts 13.

While the present invention has thus far been described in connection with a few embodiments thereof, it will readily be possible for those skilled in the art to put this invention into practice in various other manners. For example, although cases of connecting an FPC has been described in the above embodiments, it is a matter of course that the present invention can be applied also to other kinds of flat cables.

What is claimed is:

1. A cable connector for use in connecting a cable having a first and a second surface opposite to each other in a thickness direction thereof, said cable connector comprising:

a conductive contact including a contact portion to be opposed to said first surface and a pivot portion to be opposed to said second surface;

an insulator holding said conductive contact; and a handle coupled to said insulator for pressing said cable onto said contact portion;

said handle comprising:

a cam portion positioned between said pivot portion and said cable; and a surface defining a hole in which said pivot portion is inserted with a clearance, said pivot portion having a concavity corresponding to said cam portion, said cam portion engaging with said pivot portion so that said handle is rotatable around said pivot portion.

2. A cable connector according to claim 1, wherein said insulator having an engagement portion which engages with said handle to hold said handle in a state that each of said cam portions is distant from said contact portion when said cable is not connected.

3. A cable connector according to claim 1, wherein said cable is a flat cable including edge portions opposite to each other in a width direction perpendicular to said thickness direction, said insulator having a cable engagement groove which receives one of said side edges to limit movement of said flat cable in said thickness direction when said flat cable is connected.

4. A cable connector according to claim 1, wherein said contact portion has a plurality of contact-side projections which are adjacent to each other with a distance left therebetween, said handle having a handle-side projection which is opposed to said distance through said cable in said thickness direction, said handle-side and said contact-side projections being cooperated with each other to engage with said cable.

5. A cable connector for use in connecting a cable having a first and a second surface opposite to each other in a thickness direction thereof, said cable connector comprising:

a conductive contact comprising a contact portion located to be opposite to said first surface and a pivot portion located to be opposite to said second surface;

an insulator holding said conductive contact; and a handle coupled to said insulator for pressing said cable onto said contact portion, said contact portion having a plurality of contact-side projections which are adjacent to each other with a distance left therebetween in a longitudinal direction relative to said contact portion, said handle having a handle-side projection which is opposed to said distance through said cable in said thickness direction, said handle-side and said contact-side projections cooperating with each other to engage with said cable.

6. A cable connector for use in connecting a cable having a first and a second surface opposite to each other in a thickness direction thereof, said cable connector comprising:

a conductive contact including a contact portion to be opposite to said first surface and a pivot portion to be opposite to said second surface;

an insulator holding said conductive contact;

a handle coupled to said insulator for pressing said cable onto said contact portion;

said handle comprising:

a cam portion positioned between said pivot portion and said cable;

a surface defining a hole in which said pivot portion is inserted with a clearance, said pivot portion having a concavity corresponding to said cam portion, said cam portion engaging with said pivot portion so that said handle is rotatable around said pivot portion, wherein said contact portion has a plurality of contact-side projections which are adjacent to each other with a distance left therebetween, said handle having a handle-side protection which is opposed to said distance through said cable in said thickness direction, said handle-side and said contact-side protections cooperating with each other to engage with said cable, and wherein said conductive contact further comprises a pivot portion opposed to said second surface, said handle having a cam portion positioned between said pivot portion and said cable, said handle-side projection being coupled to said cam portion.

* * * * *